United States Patent [19]

Dürr et al.

[11] Patent Number: 4,497,158

[45] Date of Patent: Feb. 5, 1985

[54] PROCESS FOR FILLING PHARMACEUTICAL PRODUCTS HIGHLY VISCOUS AT ROOM TEMPERATURE INTO HARD CAPSULES

[75] Inventors: Manfred Dürr, Pulheim-Brauweiler; Hans-Ulrich Fribolin, Neuss, both of Fed. Rep. of Germany

[73] Assignee: A. Natterman & Cie GmbH, Cologne, Fed. Rep. of Germany

[21] Appl. No.: 269,627

[22] Filed: Jun. 2, 1981

[30] Foreign Application Priority Data

Jul. 13, 1980 [DE] Fed. Rep. of Germany ..... 3022137

[51] Int. Cl.[3] ..... B65B 1/20; B65B 55/14

[52] U.S. Cl. ..... 53/428; 53/440; 424/37

[58] Field of Search ..... 53/111 RC, 111 R, 127, 53/428, 440, 431; 141/11, 69, 70; 222/190; 604/890-892; 424/36, 37; 264/4

[56] References Cited

U.S. PATENT DOCUMENTS

| | | | |
|---|---|---|---|
| 2,837,881 | 6/1958 | Schneider | 53/111 RC |
| 3,126,321 | 3/1964 | Kurtz | 424/37 X |
| 3,780,195 | 12/1973 | Balassa | 424/37 X |

*Primary Examiner*—A. J. Heinz

*Attorney, Agent, or Firm*—Pearne, Gordon, Sessions, McCoy, Granger & Tilberry

[57] ABSTRACT

The present invention is related to a process for filling pharmaceutical products which are highly viscous at room temperature, into hard capsules by admixing to such products a solvent or mixture of solvents in particular amounts, said solvent or solvent mixture having particular evaporation properties, and ejecting the resulting product from a usual filler nozzle under particular conditions, and closing the filled capsule with its cap.

2 Claims, No Drawings

PROCESS FOR FILLING PHARMACEUTICAL PRODUCTS HIGHLY VISCOUS AT ROOM TEMPERATURE INTO HARD CAPSULES

The present invention is related to a process for filling pharmaceutical products which are highly viscous at room temperature, into hard capsules.

The filling of highly viscous products such as oily or sticky highly viscous products is very difficult. There are many products in the food and pharmaceutical industry which do not represent powders or solutions and therefor only with difficulty can be converted into a usual trade form. A possible trade form for such products is a capsule filled with such products. However, the filling of such highly viscous products into capsules is again difficult since such products during filling tend to produce threads and to be ropy and therefor do not allow to be filled into capsules.

Many efforts have been made to fill such highly viscous products into soft gelatine capsules. The soft gelatine capsule however has the disadvantage that only liquid products may be filled into them having a predominently lipophilic nature since the capsule itself may be changed in other undesired ways such is hardening or becoming brittle. Since the product filled into the capsule remains liquid there may occur in the soft gelatine capsule a demixing or sedimentation of the filled product as well as leaker formation at the seam of the capsule. Furthermore, the products to be filled have to have special physical properties in order to allow a good filling into the soft gelatine capsule wherefor quite often it is not possible to fill highly concentrated and highly viscous products into soft gelatine capsules. Furthermore, the production of soft gelatine capsules is technically very complicated and may be effected only in special machines. Still furthermore there are necessary higher amounts of gelatine for soft gelatine capsule than for hard gelatine capsules.

Therefor, it would represent an improvement to fill such products into hard capsules. Many proposals for the solution of this problem have been made. For instance, pasty and semisolid products have been extruded and pressed into capsules (see German Offenlegungsschrift No. 26 12 472) or have been filled into capsules in the form of thixotropic gels or melts which behave as a liquid during the filling procedure but act as solids within the capsule (see British Pat. No. 1892, German Offenlegungsschrift No. 28 38 387, A. CUINE et al., Pharmaz. Industrie 1978, vol. 40, p. 654 to 657). However, in order to allow a filling of the capsule in an exact amount, the product to be filled should not have too high a viscosity at the filling temperature, has to have a suitable surface tension and should not produce threads during filling. Furthermore, a leakage from the capsule should not occur even after closure of the capsule with its cap without additional measures such as sealing of the capsule.

However, in these processes the viscosity difference between the liquid and the solid phase either is not large enough or the conversion from the liquid into the solid phase is too slow. Furthermore, when using meltable products such products are heated for too long a time in the storage bunkers or bins. Such processes therefor cannot be applied to the filling with high speed filling machines in particular because of thread formation, too long heating in the storage bins and too slow a solidification of the filled product in the capsule.

In another process the products are filled into the capsules in the presence of a solvent (see British Pat. No. 767 073). The solvent after filling is removed from the filled capsule by evaporation at elevated temperature before the capsule is closed. It is a disadvantage of this process that the lower capsule half has to be kept in a vertical position in the filling machine or in a subsequent part of the machine during the evaporation step until the solvent has been removed. During the evaporation of the solvent there may occur a decomposition of the often sensible active component due to the necessary heating. Furthermore, the solvent to be evaporated may destroy the capsule wall at the temperatures of evaporation. The complete process is quite complicated and therefore may not be carried out with usual filler machines.

It has now been found that products which are highly viscous at room temperature may be readily filled into hard capsules, in particular into hard gelatine capsules, as follows:

(a) to the highly viscous product, possibly after the addition of usual gelanic additives, there is added a solvent volatile at normal pressure or a mixture of several such solvents in such an amount that the resulting concentrated solution, emulgation or suspension of the product to be filled represents a flowable product at room temperature or at slightly elevated temperature under the pressure as it is produced for instance by pumps, i.e. the viscosity of the resulting product is such that it is just sufficiently low for transportation under pressure at this temperature or the viscosity is even slightly lower;

(b) this product now is filled into the hard capsule with usual filling machines for the filling of liquids with a heatable filler nozzle, i.e. the product is filled from the nozzle opening arranged in usual distance from the opening of the hard capsule half to be filled, the product being heated to a temperature close to the boiling point of the usual solvent or solvent mixture, under pressure to the product before ejection from the filler nozzle;

(c) the filled hard capsule half is finally closed in usual manner with the other hard capsule half. The nozzle opening preferably has a diameter of 0.3 to 1.5 millimeters.

Most suitable for the filling are mixtures consisting of 10 to 98% of the highly viscous product and 0.5 to 10%, in particular 0.5 to 5% of a solvent or solvent mixture, possibly with the addition of usual gelanic additives.

The mixing proportion of the various components, i.e. the product to be filled, the solvent or solvent mixture and, possibly, usual galenic additives is such that the resulting product has a sufficiently low viscosity for being transported from the storage bunker or bin with usual pumps, i.e. the viscosity being from 1,000 to 100,000 mPa/sec. at a temperature between 20° and 110° C. In order to guaranty that there does not remain too much solvent in the product filled into the capsules and that it quickly solidifies in the capsule, there should be added to the highly viscous product only so much solvent that the resulting product has a viscosity just sufficient for transport under pressure at usual storage temperatures, i.e. at room temperature or slightly elevated temperature, or a slightly lower viscosity at such temperatures.

For producing filled capsules the highly viscous products are converted by the addition of the volatile solvents into concentrated solutions, emulsions or suspensions having a sufficient flowability at for instance room temperature, which then are filled with usual filling machines with usual equipment for filling liquids. Suitable filling machines are for instance ZANASI-machines or HÖFLINGER & KARG and in particular machines working with high pressure and especially controlled valves such as NORDSON & DITTBRENNER machines. In such machines the products with simultaneous control of pressure and temperature are filled into the capsules by means of a dosing valve wherein the product mix is subjected to heating only for a short period of time. When filling the highly viscous products in such a way there surprisingly does not occur a spraying of the product to be filled nor any evaporation of the solvent with foaming. However, the solvent is evaporated in such an amount that the product filled into the capsule solidifies momentarily. The evaporation of the solvent may be controlled in particular by the size of the nozzle and by the pressure during filling, i.e. by the flow speed and, therefor, the time the product remains between the exit of the nozzle opening and the inlet opening of the hard capsule. It is particularly preferred to apply high pressure since apparently therewith an enlargement of the surface of the product jet during filling and thereby an increased evaporation of the solvent occurs which again causes a better and more speedy solidification of the product within the capsule. After filling, the filled capsule is directly closed by adding the upper capsule cap without any further treatment of the capsules and is taken from the filling machine without danger of leakage.

The capsules may be furthermore provided with a coating resistant to the juices of the stomach. Such coatings are usual natural or synthetic lacquers such as shellac, celluloseacetatephthalate, hydroxymethylcellulosephthalate or acrylic resins such as Eudragit (polyacrylic acids). Highly viscous products which may be filled into capsules by this process are in particular products usual in the pharmaceutical industry: extracts from plants, ethereal oils, fats, phospholipids and other therapeutically useful products, possibly admixed with lipophilic products such as solid or semisolid waxes, for instance bee wax, carnauba wax, cetylpalmitate, woolwax, lanoline; hydrated oils such as peanut oil, cotton oil, ricinus oil; natural, semisynthetical triglycerides and their mixtures with cocoa butter as well as ususal suppository products, for instance triglyceride products such as Witepsol ®-suppository product (compare H. P. FIEDLER, Lexikon der Hilfsstoffe für Pharmazie, Kosmetik und angrenzende Gebiete, 1971, vol. 9, pgs. 548 to 550 and 632 to 634); fatty alcohols such as lauryl alcohol, myristyl alcohol, cetyl alcohol, stearyl alcohol, cetylstearyl alcohol, woolwax alcohols, cholesterol, solid hydrocarbons such as petroleum jelly (vaseline) or solid paraffin sodium; saturated fatty acid such as lauric, myristic, palmitic or stearic acids; emulgators such as ethoxylated triglycerides, polyethoxylated plant oils; fatty acid sugar esters, silicons, hydrophylic products such as gelatine, methylcellulose, hydroxypropylcellulose, Hydroxypropylmethylcellulose, polyethenylglycoles having a molecular weight ranging from 600 to 10,000 and mixtures thereof, polyvinylpyrrolidone, polyvinylalcohol, polyacrylic acid and its salts. For optimizing the physical properties of the products to be filled into the capsule there may be added additives liquid but not volatile at room temperature such as glycerol, solcetal, acid amides such as dimethylacetamide or propyleneglycoles, fatty oils such as olive oil, peanut oil, ricinus oil, soyabean oil, mixtures of triglycerides, isopropylmyristate, ethyloleate, polyethyleneglycol having a molecular weight ranging from 200 to 400 or liquid paraffins. The present process may also be applied to lecithines or phospholipides.

The volatile solvents used in the present process may be for instance water, alcohols such as methanol, ethanol, n-propanol, isopropanol, halogenated hydrocarbons, ketones such as acetone or methylethylketone, tetrahydrofuran, esters such as methylacetate, ethylacetate, butylacetate, methylpropionate, ethylpropionate or hydrocarbons such as n-pentan, n-hexan, n-heptan or cyclohexan. Preferred are the readily volatile, physiologically acceptable solvents, in particular ethanol.

The following examples serve to further illustrate the present invention without however limiting the same thereto.

EXAMPLE 1

Phosphatidylcholine: 73 g.
Witepsol W 35: 17 g.
Soya-bean oil: 10 g.
Ethanol: 4 g.

The above products are mixed in a storage vessel with stirring and heating to about 40° C. The resulting solution is filled into capsule by means of a capsule filling machine of the type ZANASI AZ 20 L, the dosage nozzle whereof is heated to 80° C., at a filling speed of 12,000 capsules per hour. The mixture solidifies immediately in the capsule. The capsule is closed by adding its cap thereto and may be removed from the filling machine. The disintigration time of the capsule is determined as described in the test procedure "disintigration of tablets" according to Ph. Eur. III and is below 5 minutes.

EXAMPLE 2

The products of Example 1 are mixed as described in Example 1. They are however filled by means of a filling machine of the type HÖFLINGER & KARG GFK 330 L with the same result.

EXAMPLE 3

Phosphatidylcholine: 73 g.
Witepsol W 35: 17 g.
Soya-bean oil: 10 g.
Ethanol: 2 g.

The products are mixed as described in Example 1 and are filled into capsules using a filling machine of the type HÖFLINGER & KARG GFK 330 with additional equipment for filling liquid products having a compressed-air-controlled magnetic valve, at a filling pressure of about 75 bar. The machine produces 20,000 capsules per hour.

In the same manner as described in Examples 1 to 3 the following mixtures are filled into capsules:

EXAMPLE 4

Phosphatidylcholine: 73 g.
Cetylstearylalcohol: 13 g.
Polyethyleneglycol 400: 10 g.
Cetaceum: 4 g.
Ethanol: 3 g.

EXAMPLE 5

Phosphatidylcholine: 73 g.
Polyethyleneglycol 400: 21.6 g.
Polyethyleneglycol 10,000: 5.4 g.
Ethanol: 3 g.

EXAMPLE 6

Indometacine: 14 g.
Phosphatidylcholine: 63 g.
Witepsol W 35: 14.5 g.
Soya-bean oil: 8.5 g.
Ethanol: 2 g.

EXAMPLE 7

Acetylsalicic acid: 40 g.
Phosphatidylcholine: 40 g.
Witepsol W 35: 13 g.
Soya-bean oil: 7 g.
Ethanol: 5 g.

EXAMPLE 8

7-β-Hydroxyethyltheophylline: 10 g.
Phosphatidylcholine: 60 g.
Witepsol W 35: 15 g.
Soya-bean oil: 14 g.
DL-α-tocopherol: 1 g.
Ethanol: 2 g.

EXAMPLE 9

Hippocastanium extract: 54 g.
Hesperidinmethylchalcon: 13 g.
Phosphatidylcholine: 20 g.
Witepsol W 35: 7 g.
Soya-bean oil: 6 g.
Ethanol: 3 g.

EXAMPLE 10

Dimethylpolysiloxane: 84 g.
Witepsol W 35: 16 g.
Ethanol: 1 g.

EXAMPLE 11

Polyethyleneglycol 20,000: 66.4 g.
Polyethyleneglycol 600: 33.6 g.
Ethanol: 4 g.

EXAMPLE 12

Phosphatidylcholine: 73 g.
Witepsol W 35: 17 g.
Soya-bean oil: 10 g.
Ethylacetate: 7.5 g.

EXAMPLE 13

Phosphatidylcholine: 73 g.
Witepsol W 35: 17 g.
Soya-bean oil: 10 g.
Isopropanol: 4 g.

EXAMPLE 14

Phosphatidylcholine: 73 g.
Witepsol W 35: 16 g.
Soya-bean oil: 10 g.
Cholesterol: 1 g.
Ethanol: 3 g.

EXAMPLE 15

Fully hydrated phosphatidylcholine: 8 g.
Phosphatidylcholine: 65 g.
Witepsol W 35: 16 g.
Soya-bean oil: 10 g.
Ethylacetate: 7 g.

What we claim is:

1. Process for filling pharmaceutical products which are highly viscous at room temperature into hard gelatin capsules comprising admixing a solvent volatile at normal pressure or a mixture of several such solvents to the highly viscous product in such an amount that the resulting product at room temperature or slightly elevated temperature has a viscosity just sufficient to allow the transport thereof with pressure, or a slightly lower viscosity, ejecting this resulting product with pressure and heating of the product before ejection from a filler nozzle arranged with its opening opposite to the opening of the hard capsule half to be filled, said heating being sufficient to cause evaporation of admixed solvent or solvent mixture from the resulting product after it is ejected from the filler nozzle, filling the hard capsule half while simultaneously evaporating admixed solvent or solvent mixture as the resulting product is filled into the hard capsule half, and closing the filled hard capsule half with the other hard capsule half, the heating and admixed solvent content being such that substantially all of the admixed solvent evaporates between product ejection from the filler nozzle and capsule closing to produce a capsule filling which is substantially solidified and substantially devoid of admixed solvent.

2. Process according to claim 1 wherein the volatile solvent or solvent mixture has a boiling point between 25° and 110° C. and it is used in an amount of from 0.5 to 10% of the weight of the highly viscous product.

* * * * *

UNITED STATES PATENT AND TRADEMARK OFFICE

CERTIFICATE OF CORRECTION

PATENT NO. : 4,497,158

DATED : February 5, 1985

INVENTOR(S) : Manfred Durr et al.

It is certified that error appears in the above—identified patent and that said Letters Patent is hereby corrected as shown below:

On the title page;

Section [30] Foreign Application Priority Data should read:

-- June 13, 1980 [DE] Fed. Rep. of Germany..... 3022137 --

Signed and Sealed this

*Twenty-seventh* Day of *August 1985*

[SEAL]

*Attest:*

DONALD J. QUIGG

*Attesting Officer* *Acting Commissioner of Patents and Trademarks*